United States Patent [19]

Henderson

[11] 3,930,320

[45] Jan. 6, 1976

[54] NAIL POLISH DRYER

[76] Inventor: Burnis Marie Henderson, 5214 17th, Lubbock, Tex. 79408

[22] Filed: Dec. 2, 1974

[21] Appl. No.: 528,873

[52] U.S. Cl. ..... 34/202; 34/231

[51] Int. Cl.[2] ..... F26B 25/00

[58] Field of Search..... 34/202, 243 R, 212, 219, 34/104, 231; 219/366-371, 400

[56] References Cited

UNITED STATES PATENTS

| | | | |
|---|---|---|---|
| 2,184,858 | 12/1939 | Goodman | 34/202 |
| 2,260,687 | 10/1941 | Lasha | 34/202 |
| 3,258,853 | 7/1966 | Bradbury | 34/202 |
| 3,378,009 | 4/1968 | Peplin | 34/202 |

*Primary Examiner*—Kenneth W. Sprague
*Assistant Examiner*—James C. Yeung
*Attorney, Agent, or Firm*—Fishburn, Gold & Litman

[57] ABSTRACT

A nail polish dryer to effect rapid drying of polish on fingernails or toenails and includes a base and a hood defining a drying space with an access opening for insertion of the portion of a person having nails to be dried. The base has walls therein defining an air passage through the base. An air moving fan positioned in the air passage is operative to move air around a heater and through an exit defined by one or more apertures in a top wall of the base. The heated air moves toward a rib or flow director extending from a hood in spaced relation to the apertures and operating to direct heated air onto polish on the nails of a user. The fan and heater is controlled by electric circuitry including a switch that is in circuit making position when engaged by the portion of a person extending into the drying space.

6 Claims, 5 Drawing Figures

NAIL POLISH DRYER

The present invention relates to nail polish dryers and more particularly to a nail polish dryer operative to direct heated air onto the nails of a user for fast drying thereof.

The principal objects of the present invention are: to provide a nail polish dryer for home or beauty shop use which is operative for fast drying of polish on nails of fingers and toes; to provide such a dryer operative to quickly provide sufficient drying of nail polish and thereby substantially prevent any damage to polish during normal dressing and the like; to provide such a dryer operative to dry nail cleaner solutions prior to application of polish and to dry protector material placed over polish; to provide such a dryer with a relatively large drying space and easy access whereby the nails are movable to drying position with little danger of contact with other objects; to provide such a dryer having the circuit controlling switch position adjacent the access opening for operation by pressure from the hand of the user; to provide such a dryer using heated air in the range of one hundred fifteen degrees to one hundred thirty degrees Fahrenheit (115°F. – 130°F.) which is directed onto polish on nails of a user; and to provide such a dryer with a heater and fan that are protected and present no danger of injury to the user; and to provide such a nail polish dryer which is attractive in appearance, durable in construction, positive in operation, and particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include an exemplary embodiment of the present invention and illustrate various objects and features of the nail polish dryer.

REFERRING MORE IN DETAIL TO THE DRAWINGS

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Figure 3:
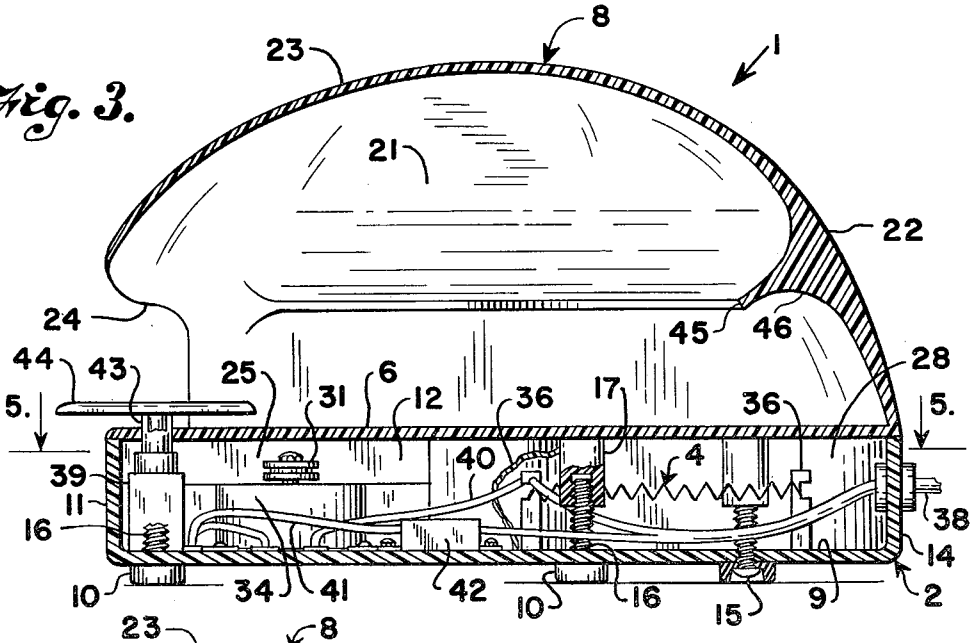
FIG. 3 is a side elevational view of the nail polish dryer with portions of a base and hook broken away to better illustrate the component parts.
Figure 2:
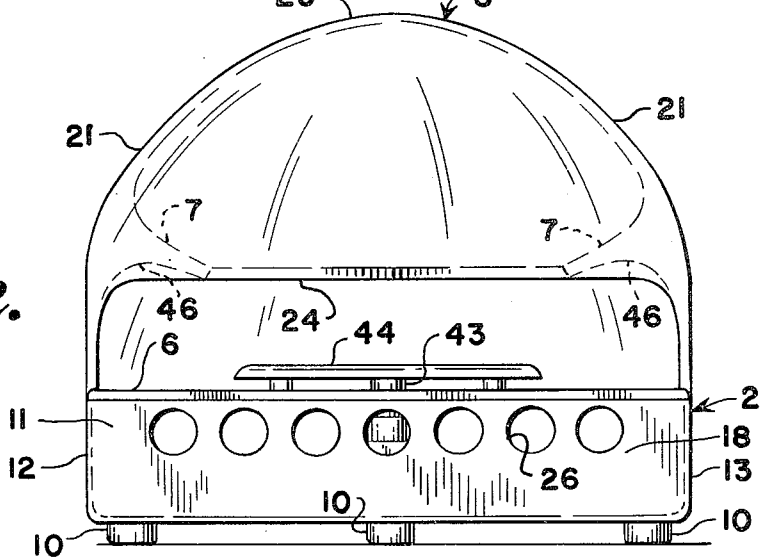
FIG. 2 is a front elevational view of the nail polish dryer.
Figure 1:
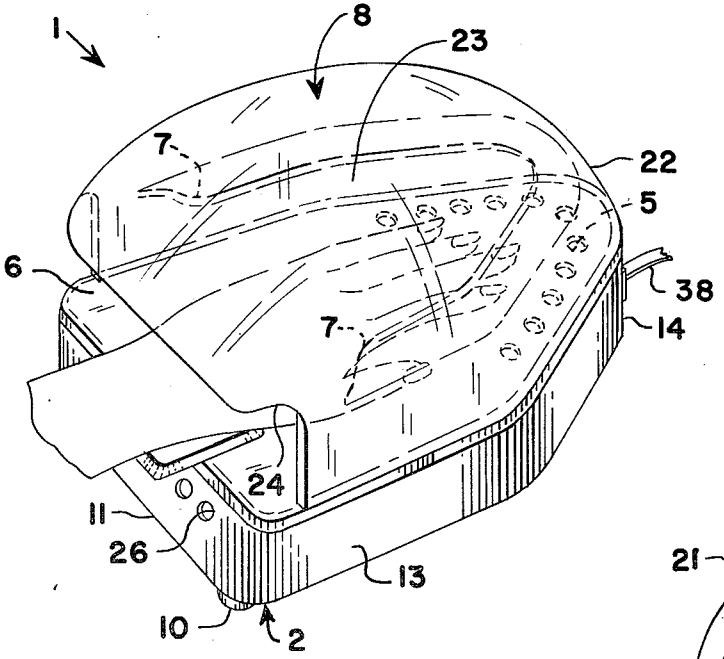
FIG. 1 is a perspective view of a nail polish dryer embodying features of the present invention.

In the disclosed embodiment of the present invention, the reference numeral 1 generally designates a nail polish dryer operative to effect rapid drying of polish on fingernails and/or toenails. The nail polish dryer 1 includes a base 2 having walls therein defining an air passage through the base 2. An air moving blower or fan 3 is in the base and relative to the air passage to move air in the passage, around a heater 4, and through an exit defined by one or more apertures 5 in a top wall 6. The heated air is moved toward a rib or flow director 7 extending from a hood 8 covering the base 2 and the heated air is thereby directed onto polish on the nails of a user. The base 2 and hood 8 are made of suitable electrical non-conductive material, such as plastic, and preferably of a molded heat resistance plastic. The hood may be of any convenient shape, such as the generally oval shape as shown in FIG. 1 or it could be shorter to enclose only the fingers of the hand.

The base 2 may be of any suitable structure adapted to support operative parts of the nail polish dryer 1. The illustrated base 2 includes a bottom wall 9 with spaced resilient pads or feet 10 thereon adapted to have supporting engagement with a surface, such as a table, dresser, or the like to prevent slipping of the nail polish dryer 1 and marring of the support surface.

The base may be fabricated by joining parts thereof but is preferably molded of plastic with one of the top wall 6 and bottom wall 9 removable. In the illustrated structure, a front wall 11, side walls 12 and 13 and rear wall 14 are upstanding from the peripheral edge of the bottom wall 9 and integral therewith. The top wall 6 has a peripheral shape corresponding to the shape of the bottom wall 9 and is removably mounted in engagement with the upper edges of the upstanding front, side, and rear walls and is secured in place as by screws 15. In the structure shown, the screws 15 also secure the feet on the bottom wall 9 and have threaded shanks 16 screwed into threaded sockets 17 of bosses on the bottom of the top wall 6.

Figures 4, 5:
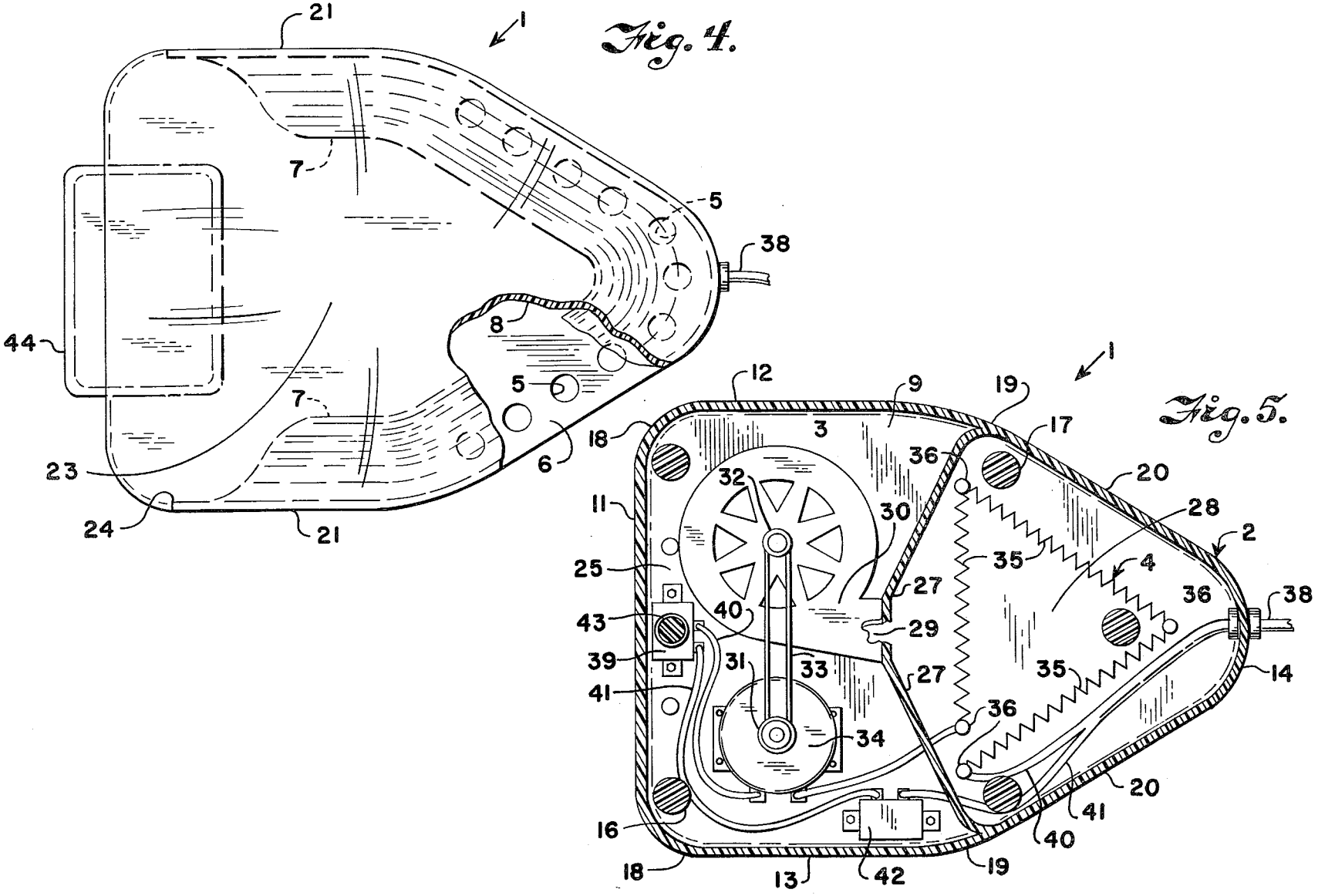
FIG. 4 is a top plan view of the nail polish dryer with portions of a hood broken away to show an exit for an air passage.
FIG. 5 is a sectional view taken on line 5—5, FIG. 2 and showing walls defining an air passage through the base.

The base may be of any suitable shape such as illustrated in FIG. 4 or other shape for receiving fingers and desired portion of the hand of the user, the shape preferably being wider at the front and narrowing toward the rear. In the form shown, the front wall 11 is substantially normal to the adjacent portion of the side walls 12 and 13 and is joined therewith by rounded corner portions 18. The side walls 12 and 13 extend rearwardly to a curved portion 19 connecting with straight portions 20 converging rearwardly and merging into an arcuate rear wall 14.

The hood 8 is mounted on the top wall 6 and may be integral therewith. The hood has side and rear wall portions 21 and 22 respectively extending upwardly and inwardly from the peripheral portion of the top wall 6 and merge into a top portion 23, said hood wall portion being curved or rounded with the top portion 23 curved downwardly toward the front to provide a generally oval shape. The hood has an access opening 24 at the front that extends around the sides preferably terminating at the rear of the rounded corner portions 18 of the base walls. The access opening 24 has a suitable length, for example, twice the heights of an adult hand, to permit the fingers and hand portion to be inserted therethrough to extend into the enclosure defined by the hood and base top wall 6 without contact with the hood walls.

The base walls define a chamber 25 and air is drawn therein by the fan 3 through suitable inlet openings 26 which may be in any of the base walls. In the structure shown, the openings 26 are in the front wall 11. The base has walls 27 extending inwardly from the curved portions 19 of the side walls 12 and 13 and cooperating therewith and with the rear, and top, and bottom walls to define a heating chamber 28. The walls 27 have an inlet passage 29 connected to the discharge 30 of the blower or fan 3 which is mounted on the bottom wall 9 of the base in the forward portion of the base chamber. The blower 3 is operatively connected, as by pulleys 31 and 32 and a belt 33 to a motor 34 operative to drive the fan 3 to move air from the inlet openings 26 to the heating chamber 28. The air from the heating chamber 28 is discharged upwardly into the hood enclosure through one or more openings 5 in the top wall 6 adjacent the side and rear hood wall portions. In the structure illustrated, the openings 5 are a plurality of spaced apertures around the rear portion and along the straight side portions.

The heater 4 is shown in the heating chamber 28 and as electrical heating elements or coils 35 supported on members 36 to space and insulate same from the base walls. The coils 35 are shown in a triangle form with one adjacent the inlet passage 29 and the others parallel to the respective straight wall portions 20 substantially under the apertures 5.

The blower 3 and the drive motor 34 therefor may be any suitable device operative to effect intake of air through the openings 26 and move the air into the inlet passage 29 and then over and around the heater 4 and then out through the aperture 5, in the top wall 6. The blower 3 is preferably of the centifugal type.

The heater 4 is preferably an electric heater having exposed heating elements 35 adapted to raise the temperature of air moved into contact therewith to a temperature in the range of one hundred fifteen degrees to one hundred thirty degrees Fahrenheit (115°–130° F.). The blower 3 and heater 4 are energized by a suitable electric circuitry adapted to be connected to an electric outlet by an electric cord which extends into the base chamber, as at 38, and is connected to a switch 39. The switch 39 is connected by conductors 40 and 41 to the motor 34 and heating coils 35. Connected in the conductors 40 and 41 is a second switch 42 that operates to interrupt the circuit in the event the dryer is turned over or improperly inclined. The switch 39 is actuated by push button have a stem 43 extending through the top wall with a large member 44 on the upper end thereof positioned to be engaged by the user's hand when in drying position. The switch 39 is preferably such that the circuit is completed only when member 44 of the control switch 39 is depressed. This completes an electrical circuit to the drive motor 34 of the blower 3 and to the heater 4 thereby effecting flow of heated air into the hood 8 through the apertures 5.

The rib or deflector 7 extends inwardly from and has a peripheral edge 45 spaced from an interior surface of the hood wall. The rib 7 is positioned above the top wall 6 of the base and above and in covering relation with the plurality of apertures 5 therein. The rib 7 has a portion of the lower surface thereof inclined downwardly toward the top wall 6 of the base 2. In the illustrated structure, the lower surface 46 of the rib 7 is concave whereby air flowing upwardly from the plurality of apertures 5 in the top wall 6 is directed downwardly toward the top wall 6 by the lower side or surface 46 of the rib 7. The hood 8 is preferably constructed of transparent material such as clear plastic, to permit the user to see the position of the hand or foot prior to depressing the switch member 43.

In using a nail polish dryer constructed as illustrated and described, the base 2 is positioned in any desired location and is preferably supported on the resilient pads 10. The user then places the hand or foot having fresh nail polish thereon through the entrance or access opening 24 in the hood 8 and positions the nails to be dried adjacent the plurality of apertures 5 and below the rib 7. After the hand or foot is in a selected position, the member 44 of the control switch 39 is depressed as by the palm of a hand or the sole of the foot thereby completing an electrical circuit to the drive motor 34 for the blower 3 and to the heater 4. Air is then moved inwardly through the apertures 26 in the front wall 11 by the blower 3 and into engagement with the heater 4, which raises the temperature of the air to a desired level effective for rapid drying of nail polish and the like on the nails within the hood 8. The air flows from the heater 4 upwardly through the apertures 5 in the top wall 6 of the base 2 and then upwardly along the hood wall and into engagement with the deflector or rib 7 which directs the heated air directly onto the nails positioned adjacent the apertures 5 in the top wall 6.

It is to be understood that while I have illustrated and described one form of my invention, it is not to be limited to the specific form or arrangement of parts wherein described and shown.

What I claim and desire to secure by Letters Patent is:

1. A nail polish dryer comprising:

a. a base having a forward portion and a rearward portion and walls therein defining an air passage therethrough, said base having a top wall and a plurality of spaced apertures in said top wall adjacent side and rear peripheral portions thereof defining an exit for the air passage;

b. an air blower within said forward portion of the base for moving air through the exit of the air passage;

c. a heater within the rear portion of said base for heating the air moving through the exit of the air passage;

d. a hood having a wall mounted on said base at the sides and rear thereof and extending therefrom in covering relation with said base and the exit for the air passage, said hood wall having an opening at the forward portion of a heighth and width for entrance of at least one hand of a user, said hood wall at the sides and rear being positioned in close proximity with said apertures in said top wall;

e. an air directing member on sides and rear of the hood wall above the apertures in said top wall and extending inwardly therefrom to adjacent nails of fingers of a hand in drying position, said air directing member being continuous with a concave lower surface to direct heated air onto polish on nails of a hand of a user positioned within said hood; and f. a control switch mounted in said base and having an actuator extending above a forward portion of said top wall of said base and operative to energize said air blower and said heater in response to engagement by the hands of a user.

2. A nail polish dryer as set forth in claim 1 wherein:

a. said air directing member has a peripheral edge thereof spaced from said hood wall and generally above nails on a hand of a user positioned in the hood;

b. said air directing member has a portion of said concaved lower surface thereof adjacent the peripheral edge thereof inclined downwardly toward said nails on a hand of a user positioned on said top wall of said base; and c. the concaved lower surface of said air directing member extends in a continuous curve from said peripheral edge to merging relation to the hood wall whereby heated air flows upwardly from said plurality of apertures in said top wall and is directed downwardly by said concaved lower surface toward nails of a hand positioned on said top wall.

3. A nail polish dryer comprising:

a. a base member having top, bottom, side, front and rear walls connected together and defining a chamber therein, said base member having its greatest width adjacent the front and rearward side wall portions in converging relation for a lesser width at the rear;

b. said top wall having a plurality of apertures therein adjacent the periphery thereof along the rear and converging side wall portions, said apertures communicating with the base chamber thereunder;

c. a generally oval shaped hood mounted on said base in substantial covering relation, said hood having a wall substantially coextensive with the side and rear periphery of the base and extending upwardly and inwardly therefrom, said hood cooperating with the base to provide an open front of a size for insertion of the fingers and a substantial portion of a user's hand for positioning in overlying relation to the top wall of the base with the finger nails near said apertures;

d. said base member having air inlet openings and an air passage communicating with said apertures;

e. blower means in the base and operative to move air from the air inlet openings, through said air passage and discharge same through said apertures into the hood enclosure;

f. heater means operative to heat the air moved by the blower means;

g. air directing means on the hood wall above the apertures and curving downwardly from said hood wall to direct air flow onto nails of the hand of a user in drying position.

4. A nail polish dryer as set forth in claim 3 wherein:

a. said base member has walls therein cooperating with the side and rear walls to define a heating chamber in a rear portion thereof adjacent to and communicating with said air discharge apertures;

b. said heating means comprises electrical heating elements located in said heating chamber; and c. said blower means is in a forward portion of said base member and has an air discharge communicating with said heating chamber to discharge air therethrough.

5. A nail polish dryer as set forth in claim 4 and including:

a. an electric circuit connected to said heating means and to blower means to energize same;

b. a switch in said circuit for controlling said circuit; and c. a switch actuator above a forward portion of the base top wall and operable in response to engagement by the hand of a user when the fingernails thereof are in drying position.

6. A nail polish dryer as set forth in claim 5 and including:

a. walls in said base member defining a heating chamber below the apertures in the top wall, and in communication therewith, said heating chamber having an inlet passage;

b. said heating means is electrical heating elements and located in said heating chamber;

c. said blower means being motor driven and having an air discharge communicating with said inlet passage to discharge air therethrough; and d. a second switch in said circuit and operable to interrupt the circuit to the heater and motor in response to a predetermined tilt of the base.

* * * * *